US005222868A

United States Patent [19]

Ehlert

[11] Patent Number: 5,222,868

[45] Date of Patent: Jun. 29, 1993

[54] WELL PUMP APPARATUS WITH INSPECTION CONDUIT

[76] Inventor: Bryan E. Ehlert, Rte. 1, Box 70, Cotulla, Tex. 78014-9708

[21] Appl. No.: 886,596

[22] Filed: May 21, 1992

[51] Int. Cl.[5] ..... F04B 21/08

[52] U.S. Cl. ..... 417/63; 417/547; 417/555.1

[58] Field of Search ..... 417/63, 547, 552, 555.1

[56] References Cited

U.S. PATENT DOCUMENTS 1,188,999 6/1916 Rose ..... 417/552
1,388,565 8/1921 Heuser ..... 417/63
3,272,144 9/1966 Vincent ..... 417/547
3,697,194 10/1972 Holmes ..... 417/547
4,257,748 3/1981 Ives et al. ..... 417/63
4,762,474 8/1988 Dartnall ..... 417/547

*Primary Examiner*—Richard A. Bertsch
*Assistant Examiner*—Charles G. Freay
*Attorney, Agent, or Firm*—Leon Gilden

[57] ABSTRACT

An apparatus having a conduit including a reciprocating plunger rod directed therethrough in a coaxially aligned relationship includes an extension conduit directed into a subterranean water supply. A fixed lower valve cooperates with a reciprocating valve mounted to a lower distal end of the plunger rod to effect lifting of water from the water table to a second outlet conduit pipe.

1 Claim, 4 Drawing Sheets

FIG 5
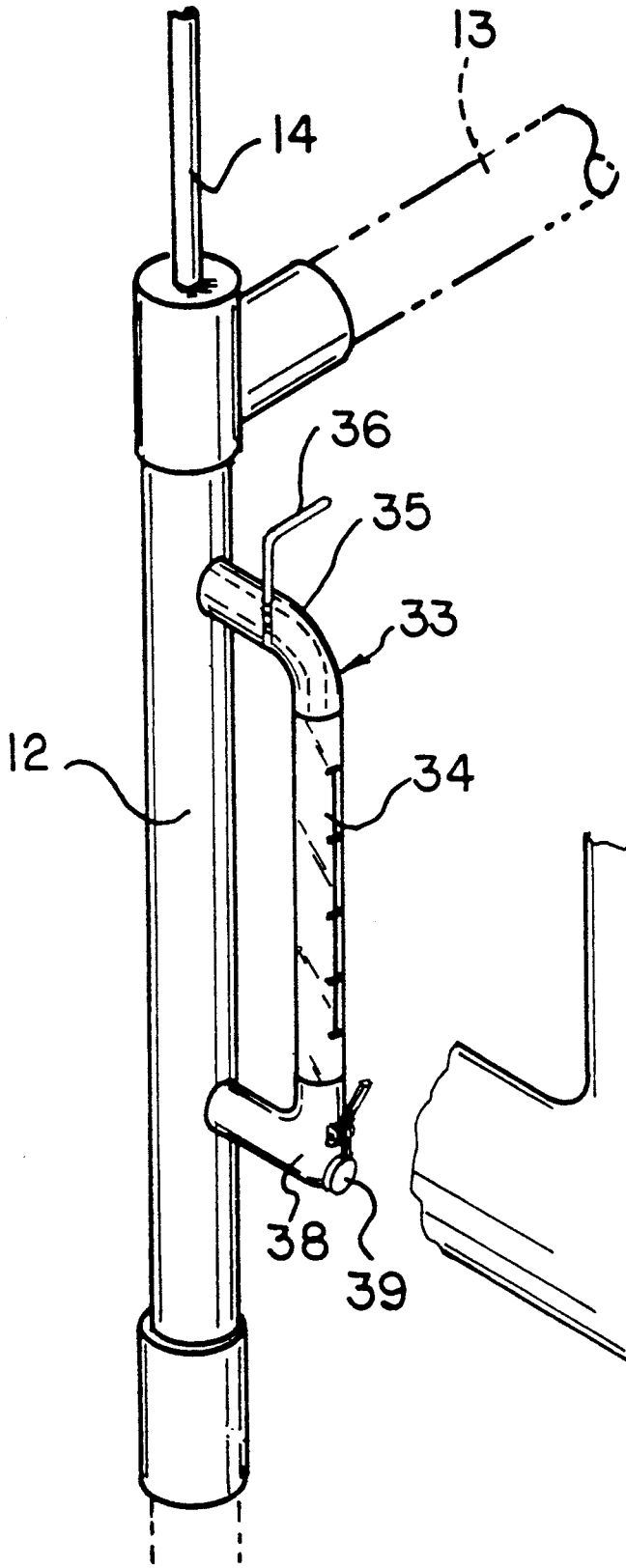
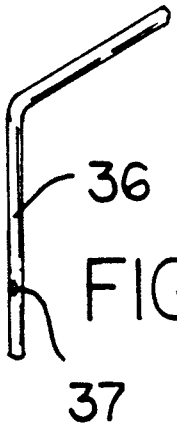
FIG 6
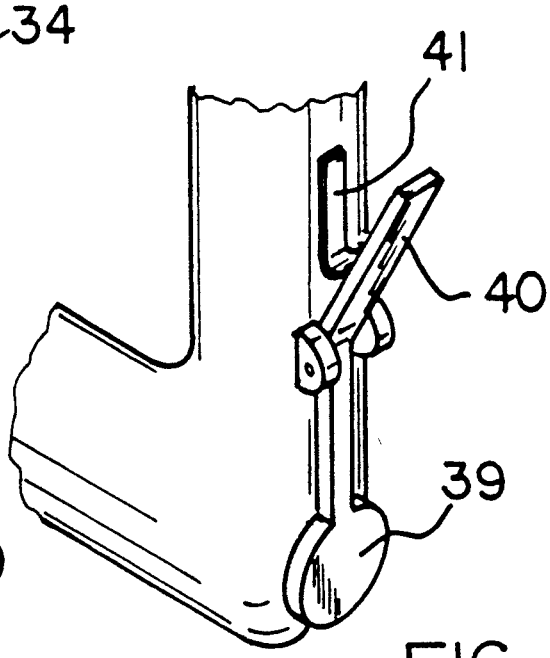
FIG 7

WELL PUMP APPARATUS WITH INSPECTION CONDUIT

BACKGROUND OF THE INVENTION

1. Field of the Invention

The field of the invention relates to pump apparatus, and more particularly pertains to a new and improved well pump apparatus arranged for the efficient pumping of fluid from a subterranean water supply.

2. Description of the Prior Art

Pump apparatus of various types are utilized in the prior art to effect pumping of various waters. A submerged pump system is set forth in U.S. Pat. No. 4,834,621 to Hall wherein a well pump utilized in the prior art is set forth in U.S. Pat. No. 4,820,137 to MacLeod. Further examples of well pumps are set forth in the U.S. Pat. Nos. 4,822,257 to Olofsson; 4,886,428 to Oloffsson; and 4,502,843 to Martin.

Accordingly, it may be appreciated that there continues to be a need for a new and improved well pump apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of well pump apparatus now present in the prior art, the present invention provides a well pump apparatus wherein the same is arranged for the drawing of water from deep wells and the like to minimize components in the pump organization by employing a fixed lower and a movable upper valve to direct fluid to an outlet conduit. As such, the general purpose of the present invention, which will be described subsequently in greater detail, is to provide a new and improved well pump apparatus which has all the advantages of the prior art well pump apparatus and none of the disadvantages.

To attain this, the present invention provides an apparatus having a conduit including a reciprocating plunger rod directed therethrough in a coaxially aligned relationship including an extension conduit directed into a subterranean water supply. A fixed lower valve cooperates with a reciprocating valve mounted to a lower distal end of the plunger rod to effect lifting of water from the water table to a second outlet conduit pipe.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the applications, which is measured by the claims, nor is it intended to be limiting as to the scope of the invention in any way.

It is therefore an object of the present invention to provide a new and improved well pump apparatus which has all the advantages of the prior art well pump apparatus and none of the disadvantages.

It is another object of the present invention to provide a new and improved well pump apparatus which may be easily and efficiently manufactured and marketed.

It is a further object of the present invention to provide a new and improved well pump apparatus which is of a durable and reliable construction.

An even further object of the present invention is to provide a new and improved well pump apparatus which is susceptible of a low cost of manufacture with regard to both materials and labor, and which accordingly is then susceptible of low prices of sale to the consuming public, thereby making such well pump apparatus economically available to the buying public.

Still yet another object of the present invention is to provide a new and improved well pump apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is an isometric illustration of the invention utilizing an inspection conduit.

FIG. 6 is an isometric illustration of the valve member utilized by the inspection conduit.

FIG. 7 is an isometric illustration of the drain plate structure utilized by the invention.

DESCRIPTION OF THE PREFERRED EMBODIMENT

Figure 1:
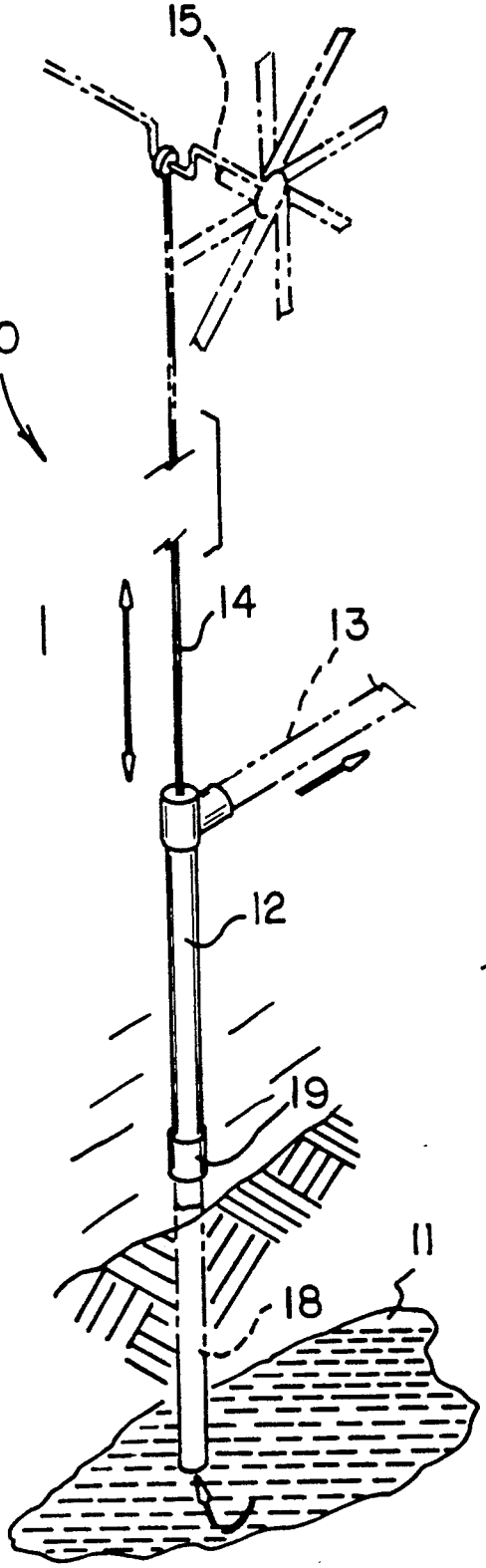
FIG. 1 is an isometric illustration of the invention.
Figure 2:
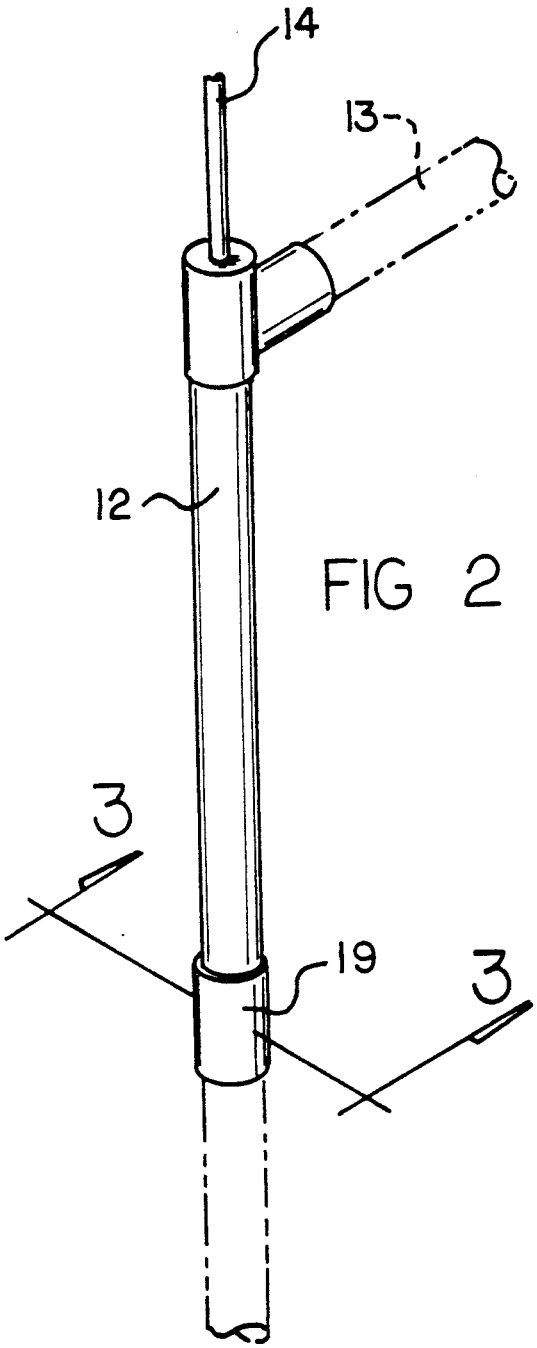
FIG. 2 is an enlarged isometric illustration of the first conduit pipe structure of the invention.
Figure 3:
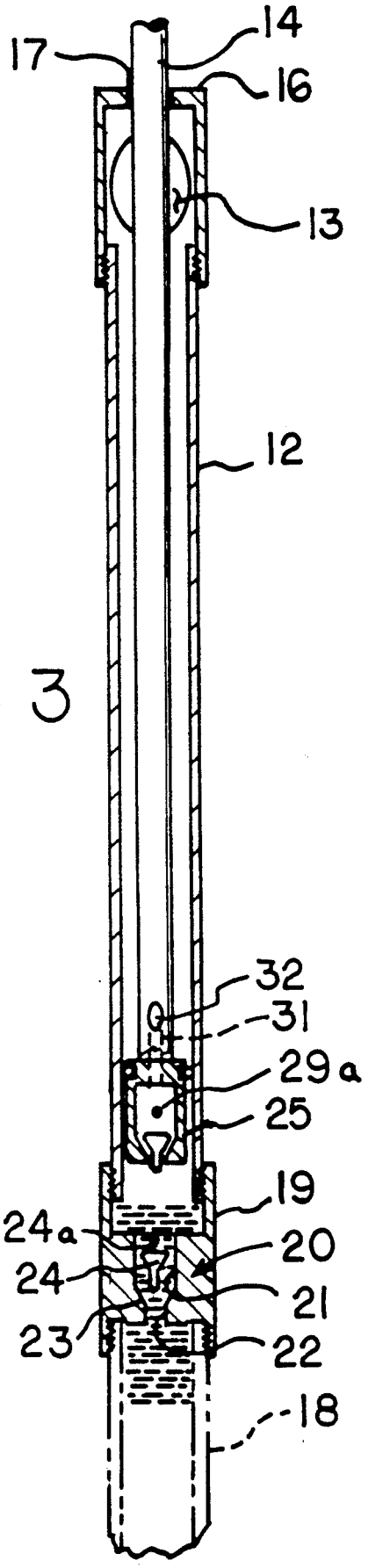
FIG. 3 is an orthographic view, taken along the lines 3—3 of FIG. 2 in the direction indicated by the arrows.
Figure 4:
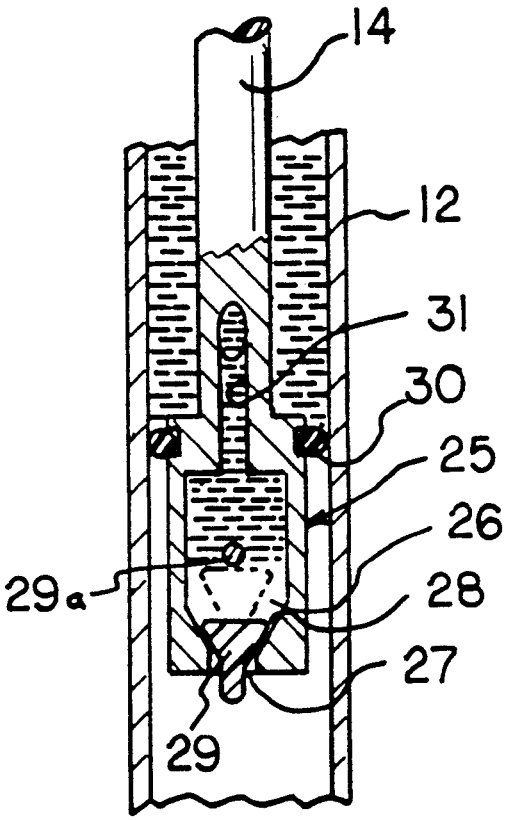
FIG. 4 is an enlarged cross-sectional view of the upper valve member as utilized by the invention.

With reference now to the drawings, and in particular to FIGS. 1 to 9 thereof, a new and improved well pump apparatus embodying the principles and concepts of the present invention and generally designated by the reference numeral 10 will be described.

More specifically, the well pump apparatus 10 of the instant invention essentially comprises a first conduit pipe 12 of a first diameter, including fluid communication with the second conduit pipe 13 adjacent an upper distal end of the first conduit pipe 12. A first conduit pipe extension conduit 18 is directed from the first conduit pipe to a subterranean water table 11. A lower distal end of the first conduit pipe 12 includes first conduit pipe lower valve support 19 mounting a lower valve assembly 20 (see FIG. 3) in a fixed orientation at a lower distal end of the first conduit pipe. A reciprocating plunger rod 14 is coaxially and slidably directed through the first conduit pipe 12 utilizing various reciprocating mechanisms 15 to include a crank and windmill arrangement for example. A first conduit pipe cap 16 having a cap bore 17 directed therethrough slidably receives the plunger rod 14 in a sealing relationship relative to the pipe cap 16.

The lower valve assembly 20 includes a lower valve 21 coaxially aligned, with the first conduit pipe 12 having a second diameter less than the first diameter, with a lower valve conduit entrance port 22 defined by a third diameter less than the second diameter, including a lower valve seat 23 at an upper end of the entrance port 22 to sealingly receive a first plug member 24. A first abutment 24*a* positioned above the first plug member within the lower valve conduit 21 controls upper displacement of the first plug member relative to the lower valve seat 23. Accordingly when the suctioning of fluid is effected by lifting of the plunger rods 14, the first plug member 24 is raised from the associated lower valve seat 23 to direct fluid through the entrance port 22 into the lower valve conduit 21 and u subsequently to the upper valve assembly 25 (see FIG. 4).

The upper valve assembly 25 includes an upper valve fluid chamber 26 positioned therewithin, wherein the fluid chamber 26 includes an entrance opening 27 at a lower end of the fluid chamber 26 having an upper valve seat 28 within the fluid chamber 26 over the entrance opening 27. A second plug member 29 reciprocatably mounted within the fluid chamber 26 is positioned over the upper valve seat 28, wherein lifting of the reciprocating plunger rod 14 effects directing the second plug member 29 onto the upper valve seat 28. A second plug member abutment 29*a* positioned within the upper valve fluid chamber 26 above the second plug member 29 controls displacement of the second plug member 29 relative to the upper valve seat 28. A chamber circuit 31 in fluid communication with the upper valve fluid chamber 26 is directed through the plunger rod 14 and includes a chamber conduit outlet port 32 directed through the plunger rod 14 to direct fluid from the upper valve fluid chamber 26 above the upper valve 25, whereupon lifting of the reciprocating plunger rod 14 forces such fluid through the second conduit pipe 13. An "O" ring sealing member 30 is provided to effect sealing of the upper valve assembly 25 relative to the first conduit pipe 12.

The FIG. 5 illustrates the use of an inspection conduit 33 having a central transparent graduated sight tube 34 arranged parallel relative to the first conduit pipe 12 spaced therefrom, with an inspection conduit entrance tube 35 in fluid communication with the first conduit pipe 12 directed from the first conduit pipe 12 into the sight tube 34. An outlet tube 38 is mounted to a lower distal end of the sight tube 35 and secured to a side wall of the first conduit pipe 12 preventing return fluid flow into the first conduit pipe 12. In this manner, the volumetric flow of fluid through the first conduit pipe 12 is ascertained by use of the sight tube 34. An entrance tube valve 36 having a valve opening 37 is rotatably mounted in the entrance tube 35 within the entrance tube pipe providing fluid flow only through the valve opening 37. Typically, an impermeable web is directed across the entrance tube 35, with the valve 36 mounted within the web permitting fluid flow through the valve opening 37 upon alignment of the valve opening 37 with fluid flow. A drain plate 39 is mounted within the outlet tube 38 having a drain plate lever 39 biased in a spaced relationship relative to the outlet tube 38 by a lever spring 41. Upon depressing the lever 40, the drain plate 39 is displaced relative to the outlet tube 38 to permit selective drainage of fluid from the sight tube 34.

Figure 9:
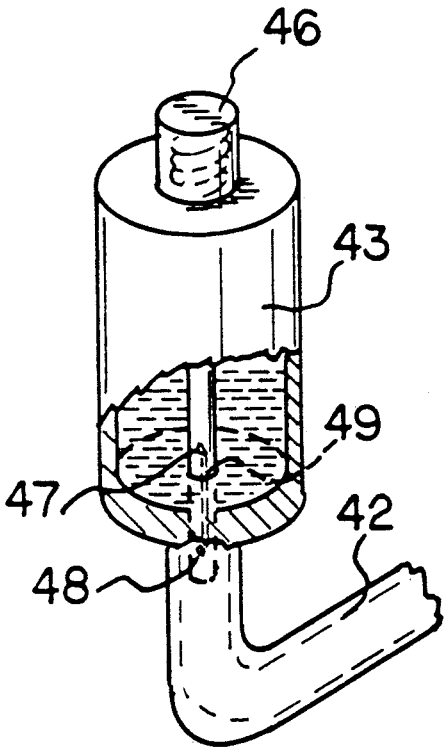
FIG. 9 is an enlarged isometric illustration, partially in section, of a fluid reservoir illustrating details thereof.
Figure 8:
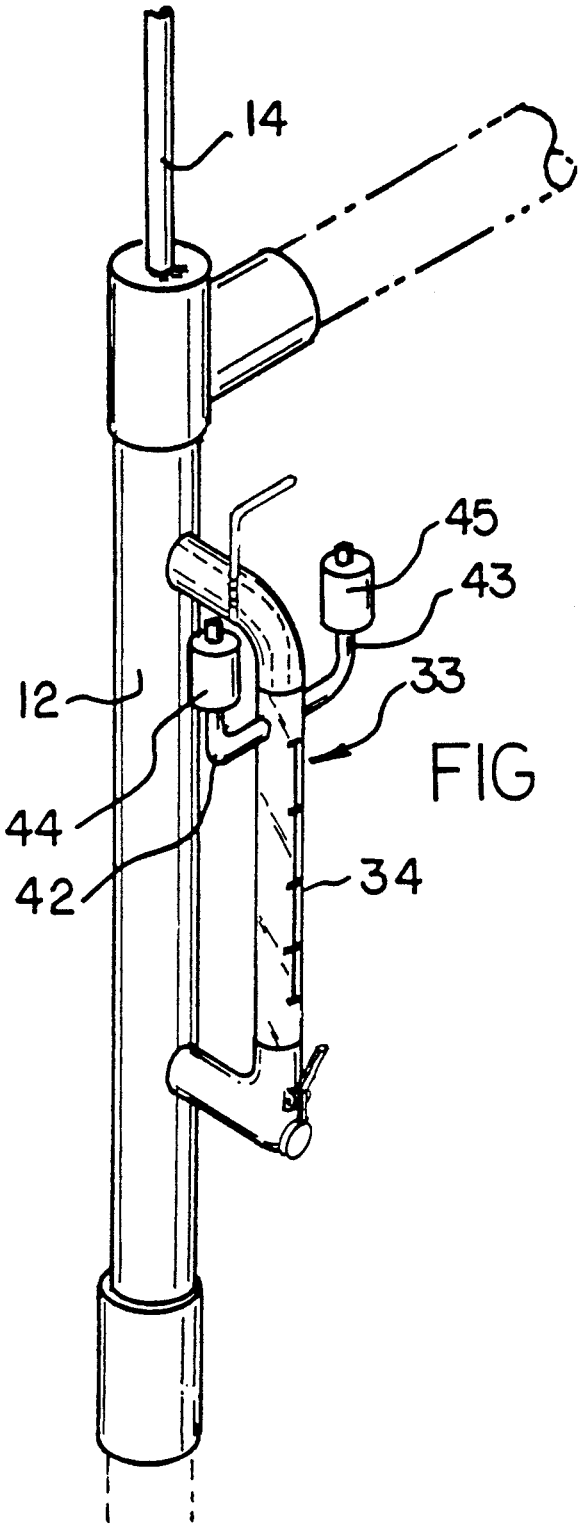
FIG. 8 is an isometric illustration of the invention employing chemical additive reservoirs for testing of fluid within the inspection conduit.

The FIGS. 8 and 9 illustrate the use of respective first and second reservoirs 44 and 45 in fluid communication with the sight tube 34 through respective first and second additive flow conduits 42 and 43. Each reservoir includes a reservoir floor, with a plunger valve rod 46 reciprocatingly mounted through the plunger rod floor in fluid communication with a respective first and second additive flow conduit 42 and 43. It should be noted that each plunger rod valve 46 includes an entrance port 47 above the floor and an exit port 48 normally positioned within the floor, with the entrance and exit ports in fluid communication between one another through a communicating conduit 49. Upon depressing the plunger valve rod 46, the exit port 48 is directed below a respective reservoir floor to permit fluid flow of chemical within one of said reservoirs into the sight tube to permit testing of water quality and the like by providing various test chemicals therewithin for testing for presence of minerals, bacteria, and the like.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A well pump apparatus, comprising, a first conduit pipe, the first conduit pipe having an upper distal end and a lower distal end, the upper distal end including a second conduit pipe in fluid communication therewith, the first conduit pipe defined by a first diameter, and a reciprocating plunger rod coaxially and slidably directed through the first conduit pipe, and the first conduit pipe including a first conduit pipe cap mounted to the upper distal end, with the plunger rod reciprocatingly directed through the cap, and a lower valve fixedly mounted to the lower distal end of the first conduit pipe, and an upper valve fixedly mounted to a lower distal end of the plunger rod, whereupon reciprocation of the plunger rod through the first conduit pipe effects directing of fluid through the lower valve and the upper valve into the second conduit pipe, and the lower valve includes a lower valve conduit, the lower valve conduit defined by a second diameter less than the first diameter, and the lower valve conduit coaxially aligned relative to the first conduit pipe, and the lower valve conduit including a lower valve conduit entrance port defined by a third diameter less than the second diameter, and a lower valve seat formed at a lower distal end of the lower valve conduit, with a first plug member removably mounted relative to the seat upon fluid flow through the lower valve conduit entrance port, and a first abutment positioned within the lower valve conduit above the first plug member, when the first plug member is positioned upon the lower valve seat, and the upper valve includes an upper valve fluid chamber coaxially aligned therethrough, with the upper valve fluid chamber including a fluid chamber entrance opening at a lower distal end of the fluid chamber, and an upper valve seat mounted within the fluid chamber at a lower end of the fluid chamber, and a second plug member removably mounted relative to the upper valve seat, with a second abutment positioned within the upper valve fluid chamber spaced above the second plug member, with the second plug member positioned upon the upper valve seat, and a chamber conduit in fluid communication with the upper valve fluid chamber directed through the plunger rod, with a chamber conduit outlet port in fluid communication with the chamber conduit, with the chamber conduit outlet port directed through the plunger rod above the upper valve, and an inspection conduit mounted to the first conduit pipe exteriorly of the first conduit pipe, with the inspection conduit including an entrance tube in fluid communication with the inspection conduit, and a central transparent graduated sight tube mounted to the entrance tube, with the sight tube arranged in a spaced parallel relationship relative to the first conduit pipe, and an outlet tube mounted to a lower distal end of the sight tube, and a drain plate positioned above a drain opening within the outlet tube, with the drain plate including a drain plate lever, and a drain plate lever spring mounted between the drain plate lever and the outlet tube, whereupon displacement of the drain plate lever effects displacement of the drain plate relative to the outlet tube permitting fluid flow therefrom, and at least one reservoir, the at least one reservoir including an additive flow conduit, with the at least one reservoir having a reservoir floor and the additive flow conduit directed from the reservoir floor into the sight tube, and a plunger valve rod coaxially directed through the at least one reservoir and the at least one reservoir floor, wherein the plunger valve rod includes a valve rod entrance port spaced above the floor and a valve rod exit port positioned in alignment with the floor when the valve rod is in fluid communication with one another to include a communicating conduit, and the exit port is spaced below the floor within the additive flow conduit when the plunger valve rod is displaced relative to the at least one reservoir to a second position displacing the valve rod exit port below the floor.

* * * * *